US007647735B2

(12) United States Patent
Kristensen

(10) Patent No.: US 7,647,735 B2
(45) Date of Patent: Jan. 19, 2010

(54) ROOFWINDOW HAVING DRAINAGE SYSTEM

(75) Inventor: Lars Kristensen, Østbirk (DK)

(73) Assignee: VKR Holding A/S, Soeborg (DK)

( * ) Notice: Subject to any disclaimer, the term of this patent is extended or adjusted under 35 U.S.C. 154(b) by 70 days.

(21) Appl. No.: 10/580,006

(22) PCT Filed: Nov. 20, 2004

(86) PCT No.: PCT/DK2004/000806

§ 371 (c)(1),
(2), (4) Date: May 19, 2006

(87) PCT Pub. No.: WO2005/049951

PCT Pub. Date: Jun. 2, 2005

(65) Prior Publication Data

US 2007/0062132 A1 Mar. 22, 2007

(30) Foreign Application Priority Data

Nov. 21, 2003 (CN) ..... 2003 1 0115368
Nov. 21, 2003 (CN) ..... 2003 2 0131965 U

(51) Int. Cl.
*E04B 7/18* (2006.01)

(52) U.S. Cl. ..... 52/200; 52/209; 49/408

(58) Field of Classification Search ..... 52/60, 52/61, 62, 169.5, 302.6, 302.3, 72, 200, 218, 52/209, 204.54, 212, 656.1; 49/408, 501, 49/504

See application file for complete search history.

(56) References Cited

U.S. PATENT DOCUMENTS

| | | | | | |
|---|---|---|---|---|---|
| 1,950,519 | A | * | 3/1934 | Ripley | 52/97 |
| 3,248,832 | A | * | 5/1966 | Ernst Leue et. al. | 52/209 |
| 3,983,669 | A | | 10/1976 | Bogaert | |
| 4,570,393 | A | * | 2/1986 | Minter | 52/72 |
| 4,776,141 | A | * | 10/1988 | Powell | 52/200 |
| 4,987,705 | A | * | 1/1991 | Sampson et al. | 52/72 |
| 5,094,040 | A | * | 3/1992 | Bunka | 52/14 |
| 5,105,593 | A | * | 4/1992 | Kaminaga et al. | 52/235 |
| 5,644,875 | A | * | 7/1997 | Nielsen | 52/204.591 |
| 5,669,186 | A | * | 9/1997 | Verby et al. | 52/72 |
| 5,687,518 | A | * | 11/1997 | Endo et al. | 52/204.1 |
| 5,913,785 | A | * | 6/1999 | M.o slashed.ller et al. | 52/200 |
| 6,286,267 | B1 | * | 9/2001 | Lindgren | 52/72 |
| 6,578,326 | B1 | * | 6/2003 | Dyrby et al. | 52/200 |
| 6,647,683 | B1 | * | 11/2003 | Thomsen et al. | 52/302.1 |

FOREIGN PATENT DOCUMENTS

| | | | |
|---|---|---|---|
| DE | 43 41 027 | | 6/1995 |
| DE | 100 63 815 | | 10/2001 |
| FR | 2 386 970 | | 11/1978 |
| GB | 1188310 | | 4/1970 |
| JP | 6-158793 | | 6/1994 |
| JP | 6158793 | A * | 6/1994 |
| JP | 2003-193762 | | 7/2003 |

* cited by examiner

*Primary Examiner*—Robert J Canfield
*Assistant Examiner*—Jessie Fonseca
(74) *Attorney, Agent, or Firm*—Merek, Blackmon & Voorhees, LLC

(57) ABSTRACT

The present invention relates to a drainage system for a roof window including at least one window frame or/and frame having walls, where at least one drainage groove is placed in the walls of the window.

6 Claims, 6 Drawing Sheets

ROOFWINDOW HAVING DRAINAGE SYSTEM

CROSS-REFERENCE TO RELATED APPLICATIONS

The present application claims the priority under 35 U.S.C. 119 of Chinese Patent Application Nos. 200310115368.4 and 200320121965.3, both filed on Nov. 21, 2003, which are hereby incorporated herein by reference in their entireties.

FIELD OF THE INVENTION

The present invention is a window drainage system for discharging rain, and dew on the window or condensate on the inner side of the window glass, in particular it relates to a drainage system for a roof window and a roof window comprising the drainage system.

BACKGROUND OF THE INVENTION

To install a window in a sloped roof, one at first needs to mount a window frame in the roof by means of supporters, then fit a glazed sash in the frame, and equip the frame and the sash with a covering and a flashing member as well as some other necessary parts.

Such a window satisfies people's normal use in a sloped roof.

Typically, a sloped roof window comprises a window frame, a sash frame, coverings, flashing members, and sealing elements. The top, bottom and lateral frame members of the window frame and the sash frame need coverings for covering the frames and protecting the wood or other material of the window from the weather such as rain, sunshine and blizzard. Meanwhile, there is a sealing provided between the frame and the sash.

The conventional window frame and sash is made of wood, in order to provide a sealing for the window, and to protect the wooden material, people usually use sealing pads or strips. Since wood tends to swell and deform due to exposure thereof to rain and moisture, people mainly consider protection of the wooden members at the outer surface of the frame and the sash, in order to isolate the wooden members from rain and moisture.

However, the window is frequently opened for ventilation, inevitably the weather will affect the wood, besides other surrounding factors. In particular when raindrops adhere the inner side of the window frame or the outer side of the sash exposed to the surroundings, the raindrops drip down along the inner surface of the window frame and the outer surface of the sash. Therefore, the seal will fail finally no matter what a good new one it is. In other word, as the time goes on, the sealing effect will go worse and the wooden members will be eroded. Besides, the temperature difference between the indoor and the outdoor causes the moisture at the inner surface of the window glass condense to water, which erodes the wooden window.

What's more, no matter which the reason for the erosion of the window wood is, rain, moisture or condensate, they all can adhere themselves on the wooden window for a long time, for example on the inner surface and the outer surface of the sash, or they can stay in cavities formed between the frame and the sash. As the cumulated water cannot be discharged soon, the penetration of the rain or water into the wood cannot be stopped in time. This is another considerable reason for erosion of the wooden window.

To solve the above disadvantages, people have tried hard to improve the structure of the window. As disclosed in WO99/51831 "A ROOF WINDOW WITH MAIN FRAME AND SASH COVERING MEMBERS", the bottom frame member of the window frame is covered by an covering, while the bottom member of the sash frame is covered by another covering, which covers the covering for the bottom member of the window frame. The cavity formed between coverings can generate vertexes, which prevent the window frame and the sash frame from the weather. Although the coverings are well windproof and waterproof, it is possible that rain, dew and condensate still enter into the window.

Materials for manufacturing windows have changed. Aluminum alloy, plastic, metal and nonmetal complex are used for making windows. Some high strength, waterproof and erosion-resistant materials are used for manufacturing the window frame and the sash frame. Now, people are trying to solve the sealing problem in roof windows.

SUMMARY OF THE INVENTION

To solve the disadvantage of the present technology, the purpose of the invention is to provide, for a sloped roofwindow, a drainage system that is constructed in the sloped roofwindow. The drainage system has the function of guiding and discharging water that accumulates for various reasons, thereby improving the integrated technical performance of the window.

A frame structure of a sloped roofwindow with drainage function comprises a drainage groove configured at the surface of the frame. The drainage can drain the rain accumulated in the window.

The drainage groove can be placed at the interior surface of the frame. In this way, the drainage grooves guide and discharge the rain and condensed water formed from outside to inside or from inside to outside. Since the sash is above the frame, it allows part of the water in the drainage groove of the sash enters the drainage groove of the frame below, then the cumulated water in the window can be reasonably guided and discharged for the second time.

The drainage groove can be placed at the side part of the frame. Because the slope direction of the side part of the frame and the sloped roof are the same, it is preferably to place the drainage groove at the side parts. Of course, the drainage groove can be placed both or either one of the top part of the frame. When the drainage grooves are at the two side parts, top part of the frame, the top drainage groove, two side drainage grooves form a circular drainage groove. The exits of the drainage grooves at two sides connect to the drainage board through the bottom part of the frame.

The drainage groove in the frame has a concave surface which extends along the interior walls of the frame, which drainage groove protrudes upwardly from the interior surface of the frame to form a top surface on the frame flange.

Usually a sloped roofwindow comprises frame, sash, covering, flashing part and other window members. The frame and the sash are covered by coverings respectively. The covering of the sash covers part of the window glass at the same time, and seals the exterior surface of the window glass with sealing pad or sealing glue. The sash is partially embed in the frame, and forms the seal at the interior surface of the frame and exterior surface of the embedded part of the sash. When the window is closed, the vertical part of the sash covering also covers partially the vertical part of the frame. There is a gap between the frame covering and the sash covering.

When the frame has at the same time a circular drainage groove, due to the necessary cooperation between the frame and the sash, it forms a circular cavity between the interior surface of the frame and the flange of the drainage groove, the exterior surface of the sash and the flange of the drainage groove. When the sealing performance between the frame and the sash drops; or when it rains while the window is opened; some rain can enter the circular cavity through the gap between the coverings by the action of the wind; or the outdoor rain can directly stays at the interior surface of the frame and the exterior surface of the sash. At this time, the drainage grooves of the frame can guide and discharge the outdoor rain.

In summary, the drainage grooves of the frame can guide and discharge the rain and condensed water produced from outdoor to indoor or indoor by various reasons.

The exterior side of the top surface of the frame drainage groove, which is also the exterior side of the top surface of the frame flange, has a sealing surface cooperates with sealing elements. The sealing surface cooperates with the corresponding surface of the sash, thus forms the seal between the frame and the sash.

The sealing surface of the flange top surface of the frame drainage groove can be sloped surface; it facilitates the rotation and the opening of the sash. While the sealing surface of the flange top surface of the frame side drainage groove can be flat surface, so as to facilitate the sealing of the frame and the sash.

The bottom parts of the drainage grooves on the side parts of the frame have a curvature upwardly towards the top surface of the bottom parts. Due to the slope configuration of the frame, this certain side drainage groove design can facilitate to discharge the water through the bottom part, easy and convenient.

The width of the drainage groove narrows down from the bottom where the curvature starts, so that it has a compact and simple structure.

To the side part drainage groove, an installation groove is constructed on the bottom part surface of the frame; one end of the bottom part covering and the flashing part is embedded in the groove, the bottom part covering is put above the flashing part, the water in the drainage groove of the frame goes through the bottom part surface and bottom part covering then drops to the flashing part, finally being discharged by the flashing part.

The cross section of the grooves surface on the side parts of the frame consists of straight, curved and/or combinations of lines crossing each other forming the surface.

The cross section of the grooves surface on the top part of the frame consists of curves; it also can be of many forms. The specific groove cross section of the side or top parts of the frame can be determined on the actual needs.

A reservoir is placed independently at the interior surface of the bottom part of the frame; the reservoir can retain or withhold the condensed water from window glass. It improves the integral drainage function of the window; prevent the condensed water from penetrating along the frame or dripping into the house.

Considering that the frame is constructed in a sloped roof, the surface of the drainage groove can be a flat plane; it goes inward and forms a flange at the interior surface of the frame bottom part. Of course, the cross section of the drainage groove can be of other shape, depends on the actual condition.

Same as that the frame circular drainage groove having a sealing surface, the top surface of the frame bottom part drainage groove can have a sealing surface also. By way of the sealing elements, the sealing surface cooperates with the corresponding sealing surface of the sash bottom part, thus seals between the frame and the sash.

The frame has a sloping surface at the interior side of the bottom part of the upper part stretching from side to side between to side parts of the frame side flange and below the drainage groove.

The material of the frame and the sash can be of many kind, pure wood, pure metal, metal composition, plastics or nonmetal composition. The material of the frame and the sash of the present intention is nonmetal composition material with wood core.

The interior cross section of the frame (the top part, bottom part or side parts or their combination) is constitutive of exterior layer and interior layer and the exterior layer is coating and the interior layer is wood. The coating well protects the frame and the sash; the quality of the interior layer can be very low, thus it decreases the production cost without lowering each quality character of the window frame.

The coating is constitutive of two layers, one is PUR, and the other is paint. The paint strengthens the protection of the coating. Of course, the paint can be removed if necessary.

The thickness of the PUR layer is variable/various along the wood perimeter in certain areas from thick to thin, thus it saves the material cost to the maximum extent, lowers the production cost and facilitates the molding process.

Preferably, the drainage groove is positioned in the window frame.

Preferably, the drainage groove is positioned in the sash frame.

Preferably, the drainage groove is positioned in the window frame and the sash frame, thereby creating a main drainage system.

Preferably, the drainage groove is positioned at the inner surface of the window frame or at the outer surface of the sash frame.

Preferably, the drainage groove is positioned at the lateral frame members of the window frame.

Preferably, the drainage groove is positioned at the top frame member of the window frame.

Preferably, the drainage groove is positioned at the lateral frame members of the sash frame.

Preferably, the drainage groove is positioned at the top frame member of the sash frame.

Preferably, the drainage groove is positioned at the top frame member of the window frame.

Preferably, the drainage groove is positioned at the lateral frame members of the sash frame.

Preferably, the drainage groove is positioned at the top frame member of the sash frame.

Preferably, the drainage groove of the window frame has a concave surface, extends along the inner walls of the window frame and includes a flange protruding outwardly from the inner surface of the window frame.

Preferably, the drainage groove of the sash frame has a concave surface, extends along the outer walls of the sash frame, and includes another flange protruding from the outer surface of the sash frame.

Preferably, the drainage grooves formed in the inner surface of the window frame constitute a complex drainage channel for the window frame, while the drainage grooves formed in the outer surface of the sash frame constitute another complex drainage channel for the sash frame, and wherein the complex drainage channel for the window frame comprises the drainage grooves formed with the lateral and bottom members of the window frame, while the complex drainage channel for the sash frame comprises the drainage grooves formed with the lateral and bottom members of the sash frame.

Preferably, it further comprises a first sealing surface on the top surface of the window-frame flange and a second sealing surface on the bottom surface of the sash-frame flange, with a sealing element sandwiched between the first and second sealing surfaces.

Preferably, the drainage grooves of the window frame is correspondingly located underneath the drainage grooves of the sash frame, with the first sealing surface facing the second sealing surface, so that water overflowing from the sash-frame drainage grooves goes into the window-frame drainage grooves, and wherein the first and second sealing surfaces are horizontally oriented in the lateral frame members of the window frame and the sash frame and inclined in the top frame members of the window frame and the sash frame.

Preferably, the lower end portions of the drainage grooves of the lateral frame members of the window frame is gradually curved upwardly to the top surface of the bottom frame member of the window frame.

Preferably, the lower end portions of the drainage groove has a width which is reduced as the position for measuring the width approaches the bottom member of the window frame.

Preferably, the lower end portions of the drainage grooves on the lateral frame members of the sash frame have a curvature upwardly towards the top surface of the bottom frame member of the sash frame.

Preferably, the lower end portions of the drainage grooves have a width which is reduced as the position for measuring the width approaches the bottom member of the sash frame.

Preferably, the cross section of the drainage-groove surface of the lateral frame members of the window frame is formed by linear sections, curved sections and/or combinations thereof.

Preferably, the cross section of the drainage-groove surface of the top frame member of the window frame is formed by linear sections, curved sections and/or combinations thereof.

Preferably, the cross section of the drainage-groove surface of the lateral frame members of the sash frame consists of a portion of the outer wall surface of the sash frame and a portion of the top surface of the flange of the sash frame, wherein the top surface is inwardly inclined down.

Preferably, the cross section of the drainage-groove surface of the top frame member of the sash frame consists of a portion of the outer wall surface of the sash frame and a portion of the top surface of the flange of the sash frame, wherein the top surface is flat.

Preferably, the inner surface of the bottom frame member of the window frame is provided with a separate reservoir for receiving rain, dew and condensate from the pane.

Preferably, the bottom surface of the separate reservoir is flat and ended with a flange formed with the inner surface of the bottom frame member of the window frame.

Preferably, the top surface of the flange defines a sealing surface facing a corresponding sealing surface defined on the bottom frame member of the sash frame, with a sealing element sandwiched between the sealing surfaces.

Preferably, the separate reservoir is ended with the flanges of the drainage grooves of the lateral frame members of the window frame, and wherein the inner surface of the bottom frame member of the window frame is inclined.

Preferably, a horizontal drainage groove is positioned on the top surface of the bottom frame member of the sash frame and communicates with two exit placed at both ends of the lateral frame members of the sash frame and communicated with a flashing member.

Preferably, a mounting groove is formed in the bottom frame member of the window frame, with an end of the bottom-frame covering and an end of the flashing member hanged in that mounting groove, and the bottom-frame covering overlaps the flashing member, and thereby the drainage water from the window frame can be discharged from the covering to the flashing member.

Preferably, the drainage groove of the lateral frame members of the sash frame extends along the top surface of the bottom frame member of the sash frame to the end of the top surface, where the drainage water can be discharged to the flashing member.

Preferably, each of the window frame and the sash frame consists of an outer layer and an inner layer, and the outer layer is a coating and the inner layer is a wooden core.

Preferably, the coating is made of two layers, one of which is FUR and the other is paint.

Preferably, the thickness of the PUR layer changes along the perimeter of the wooden core.

The present invention also provides a roof window comprising a window frame, a sash frame, an covering and a flashing member, each of the window frame and the sash frame including a top frame member, a bottom frame member and two lateral frame members, characterized in that at least one drainage groove as mentioned is placed in the walls of the window frame and the sash frame.

DETAILED DESCRIPTION OF THE PREFERRED EMBODIMENT

Figure 1:
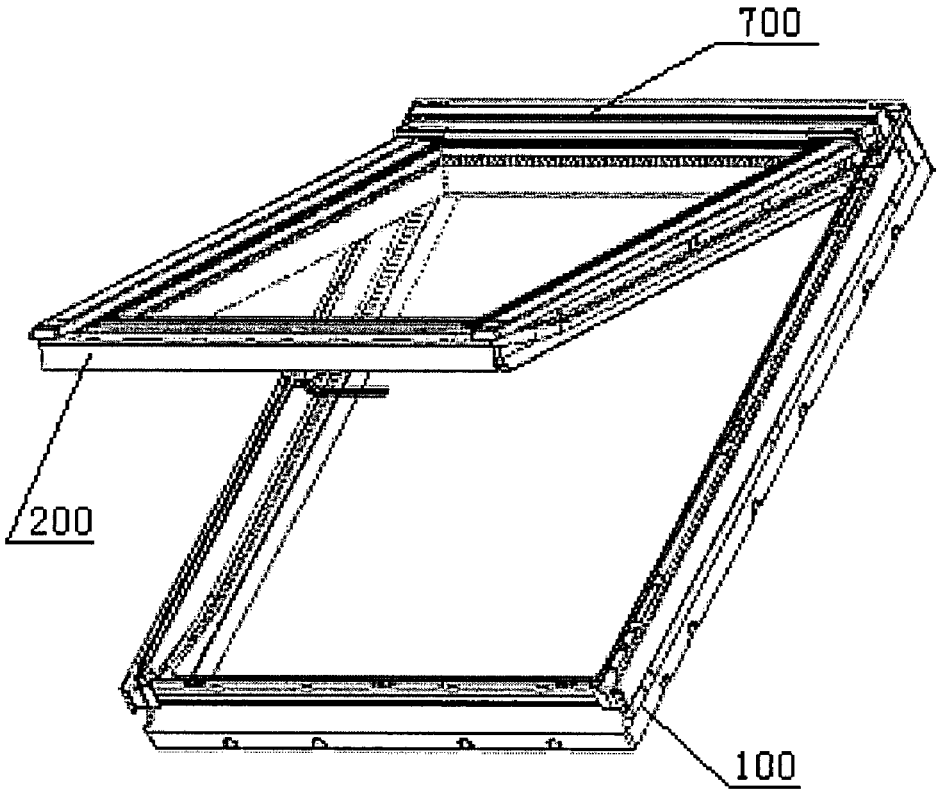
FIG. 1 is a perspective view of a roof window according to the invention.

The invention will now be described by example in detail with reference to the drawings.

A roof window installed in a sloped roof comprises a window frame 100, a sash frame 200, a window frame covering 300, a sash frame covering 400 and a flashing member. Each of the window frame 100 and the sash frame 200 comprises a top frame member, two lateral frame members and a bottom frame member. Glazing is provided with the sash frame 200.

The top frame member 110, the lateral frame members 120 and the bottom frame member 130 of the window frame are covered by respective top, lateral, bottom covering 310, 320 and 330. Similarly, the top frame member 210, lateral frame members 220 and bottom frame member 230 of the sash frame are covered by respective top, lateral, bottom covering 410, 420 and 430. Meanwhile, the top, lateral and bottom coverings overlap the glazing pane 600, thereby creating a seal between the sash covering and the glazing pane. The sash frame 200 is received in the window frame 100, and then forms a seal between the sash frame 200 and the window frame 100.

According to a preferred embodiment of the invention, some drainage grooves are formed in the window frame 100 and the sash frame 200. Particularly, a lower drainage groove 121, 111 formed in the window frame and an upper drainage groove 221, 211 formed in the sash frame constitute a drainage system according to the invention, which improves the seal between the window frame 100 and the sash frame 200.

Figure 2:
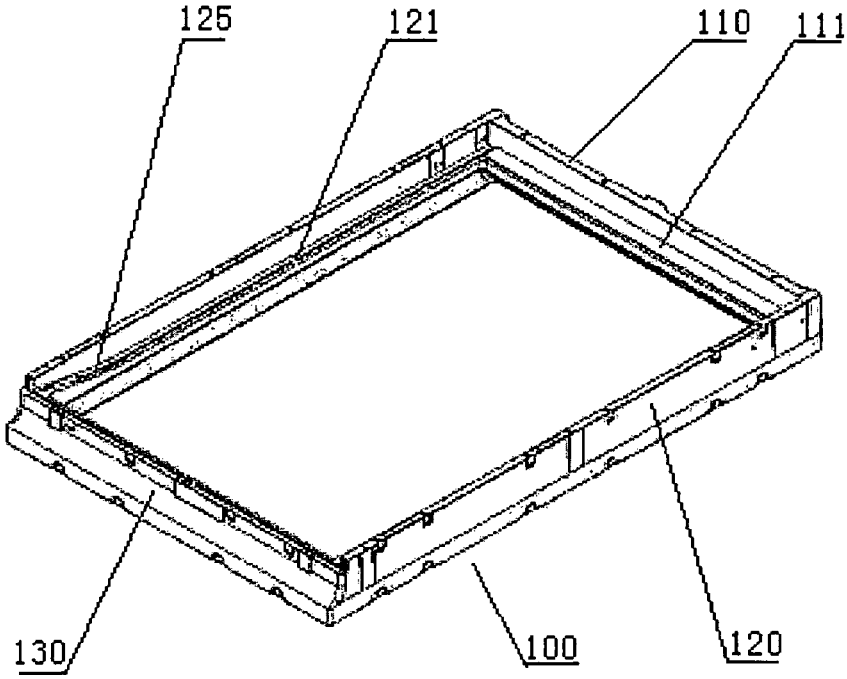
FIG. 2 is a perspective view of a window frame according to the invention.
Figure 3:
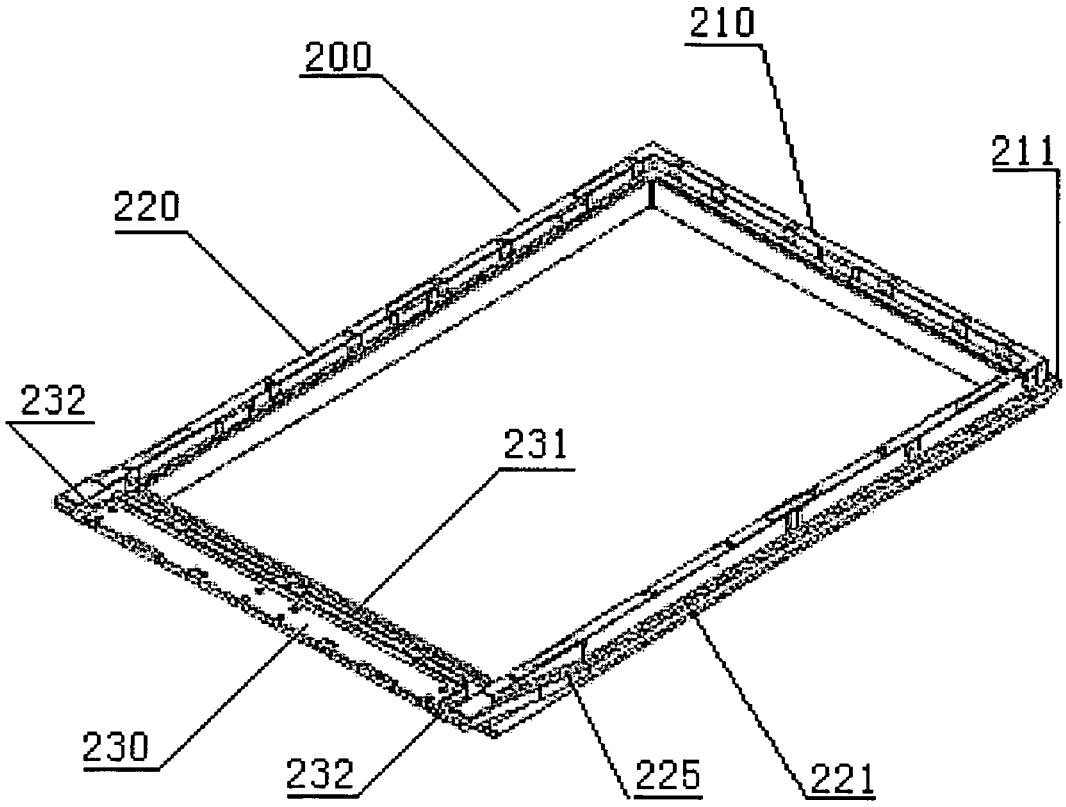
FIG. 3 is a perspective view of a sash frame according to the invention.
Figure 4:
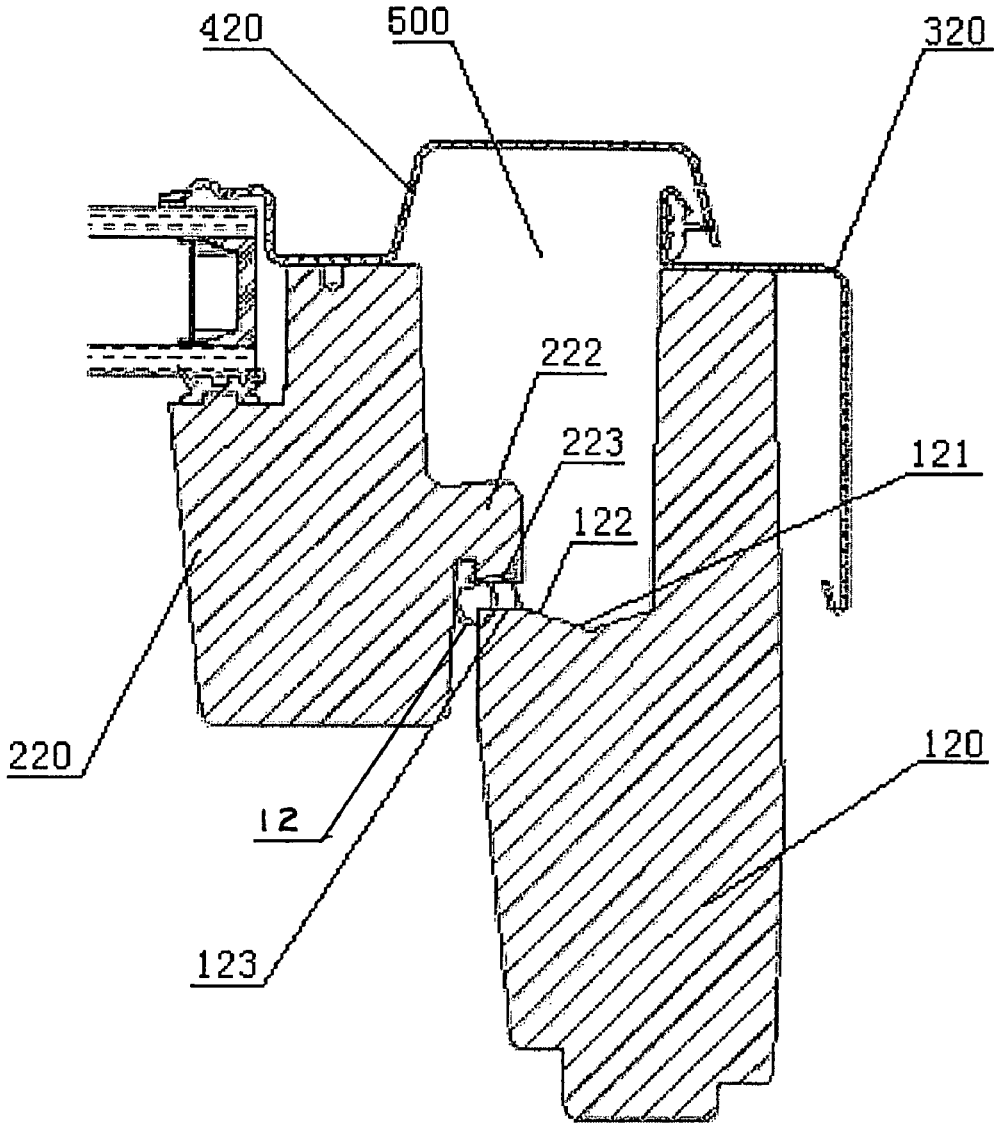
FIG. 4 is a cross section of one of the lateral frame members of each of the window frame and the sash frame according to the invention, and coverings therefor.
Figure 6:
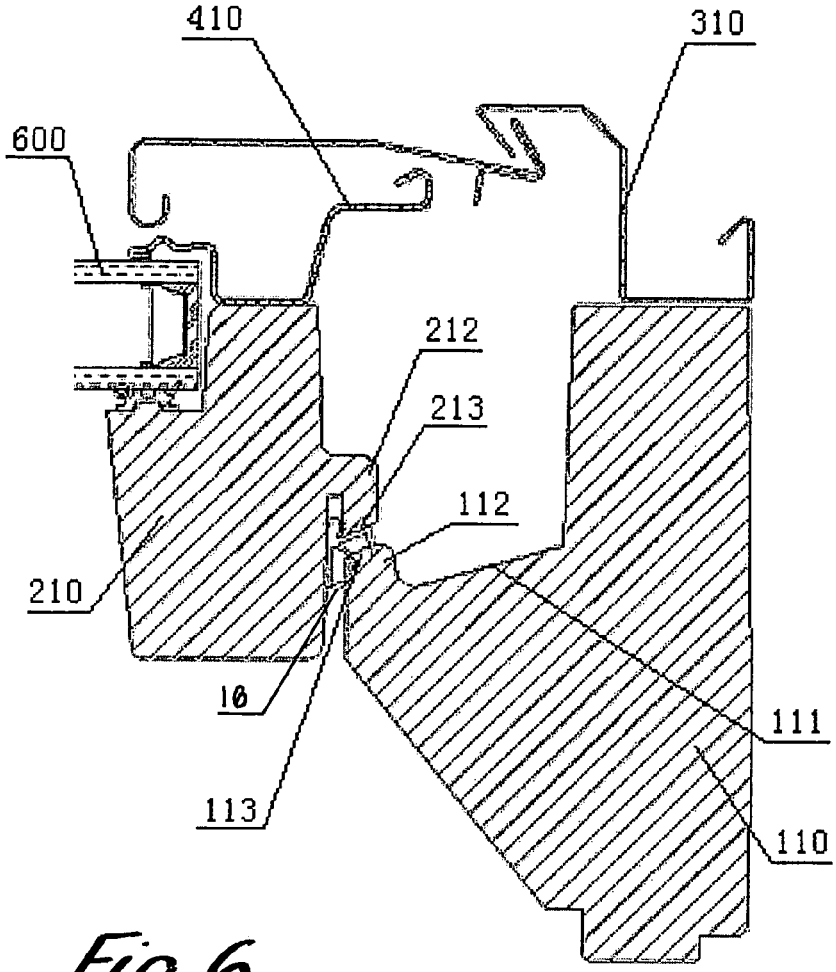
FIG. 6 is a cross section of the top frame member of each of the window frame and the sash frame according to the invention, and coverings therefor.

As shown in FIG. 2, there are drainage grooves formed in the inner walls of the top frame member 110 and the two lateral frame members 120 of the window frame 100, and formed with flanges 112, 122, as shown in FIGS. 4 and 6. Similarly, as shown in FIG. 3, there are drainage grooves 211, 221 formed in the outer wall of the top frame member 210 and the two lateral frame members 220 of the sash frame 200. The three drainage grooves 111, 121 constitute a drainage channel for the window frame 100, while the three drainage grooves 211, 221 form a drainage channel for the sash frame.

There is a first circular sealing surface 113, 123 provided on the side of the drainage groove of the window frame (facing the center of the pane), so as to create a seal by means of sealing elements 12 between the window frame 100 and the sash frame 200. Corresponding to the first circular sealing surface 113, 123, there is a second circular sealing surface 213, 223 formed in the bottom end of the flange 212, 222 formed with the drainage grooves of the sash frame. Thus, the sealing elements 12 are sandwiched between the sealing surface 113, 123 on the window frame and the sealing surface 213, 223 on the sash frame.

When the sash frame 200 is closed to the window frame 100, a circular cavity 500 is formed between the inner surface of the window frame 100 and the outer surface of the sash frame 200, which receives the drainage channels. When the sealing between the window frame and the sash frame is degenerated due to certain factors, for example, when the window is aged, or rain, dew and condensate is accumulated on the inner surface of the window frame and the outer surface of the sash frame. Specifically, the rain and dew is from the outdoor and the condensate is from the indoor. Thus, since the window frame 100 and the sash frame 200 are installed in a sloped roof, through a drainage exit configured at the lateral frame members 120 and the lateral frame members 220 of the window frame and the sash frame, the water can be guided to the surface of the bottom frame member of the window frame or the bottom frame member of the sash frame and be finally discharged to a flashing member.

Figure 5:
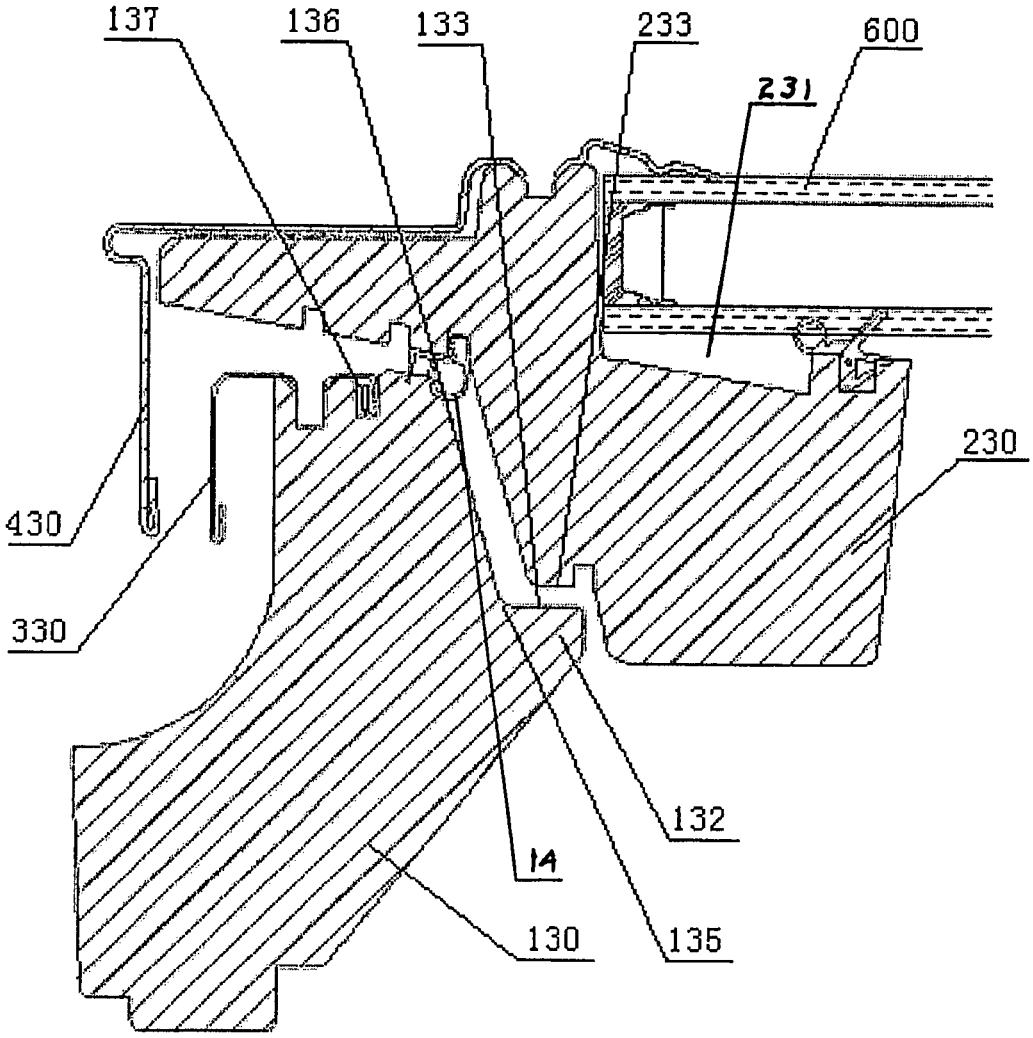
FIG. 5 is a cross section of the bottom frame member of each of the window frame and the sash frame according to the invention, and coverings therefor.

The lateral frame members 120, 220, top frame members 110, 210 and the bottom frame members 130, 230 of the window frame and the sash frame may constitute various-shape cavities, as shown in FIGS. 4, 5 and 6. However, they all create a certain room between the inner surface of the window frame and the outer surface of the sash frame. There are some factors to cause the water cumulated in this room, and the water can be drained by means of the drainage grooves according to the invention.

Also, since the sash drainage grooves 221, 211 are disposed above the frame drainage groove 121, 111; when the sash drainage grooves 221, 211 are filled with water, the water can be guided along the outer surface of the drainage groove flange 222,212 of the sash frame down to the frame drainage groove 121, 111. The flange 222 of the sash frame is spaced horizontally from the inner surface of the window frame. The upper and lower drainage grooves are combined well for drainage from the window.

When the sash frame 200 is opened, there is no sealing between the window frame 100 and the sash frame 200. In case that it is raining and windy, the rain enters the circular cavity 500; or as dew accumulates on the inner surface of the window frame and the outer surface of the sash frame. The frame drainage grooves 121, 111 and the sash drainage grooves 221, 211 collect the rain or dew water and guide the water to the flashing member (not shown), so that the water at the window-frame inner surface and the sash-frame outer surface goes down into the house.

Even when the window is closed with the sash frame 200, although the gap between the bottom covering 430 of the sash frame 200 and the bottom covering 330 of the window frame 100 is small, some rain can be forced by wind into the circular cavity 500 between the window frame 100 and the sash frame 200 through the gap, as clearly shown in FIG. 5. At this time, the window-frame drainage grooves 121, 111 and the sash-frame drainage grooves 221, 211 will discharge the water from the cavity.

The drainage groove 121 of the window frame lateral frame member has a concave surface formed by linear sections, as shown in FIG. 4. The drainage groove of the top frame member of the window frame has a concave surface formed by an inclined linear section and a curved section, as shown in FIG. 6. Of course, the concave surface of the window frame drainage grooves 121, 111 can be shaped variously depending on applications.

Since the top end of the sash frame 200 is hinged when the window opens, for a maximum range of swinging and rotation of the sash frame 200, the sealing surface on the top surface of the drainage groove flange 113 of the top frame member of the window frame and its corresponding sealing surface on the bottom surface of the drainage groove flange 213 of the top frame member of the sash frame are both inclined, thereby facilitating the rotation or opening of the sash.

Although there is a sealing element 14 sandwiched between the inner surface of the bottom frame member 130 of the window frame and the outer surface of the bottom frame member 230 of the sash frame, as described above, it is still possible that rain, dew or condensate is accumulated on and between the surfaces of the window. There is a reservoir 135 in the shape of a groove extending along the inner surface of the bottom frame member of the window frame and opened to the indoor and formed with a reservoir flange 132. The transition between the inner surface of the bottom frame member 130 of window frame and the reservoir surface is rounded, so as to store water conveniently. As can be seen from FIG. 6, there is also a sealing element 16 sandwiched between the top frame member 110 of the window frame and the top frame member 210 of the sash frame.

The inner surface of the bottom frame member 130 of the window frame is such an inclined surface 136 as to facilitate the rotation or the opening and closing of the sash. The outer end of the surface of the reservoir 135 forms a horizontal sealing surface 133 which cooperates with the sealing surface 233 of the bottom frame member of the sash frame, thereby enhancing the sealing between the bottom frame member 130 of the window frame and the bottom frame member 230 of the sash frame. The reservoir 135 is ended respectively with the inner surfaces of the lateral frame members 120 of the window frame. The reservoir 135 is formed with the bottom frame member 130 of the window frame so as to store water, and it cooperates with the sash frame 200 for an enhanced sealing therebetween. The reservoir is so incorporated into the entire window as to improve the window's performance. So are the drainage grooves 111, 121, 211 and 221.

A lateral installation groove 137 is configured on the top surface of the bottom frame member 130 of the window frame, and the covering 330 for the bottom frame member of the window frame and one end of the flashing member are engaged in the installation groove 137 (The flashing member is not shown), with the covering 330 for bottom frame member overlapping the flashing member. In order to guide the water in the window-frame drainage groove to the flashing member along the surface of the bottom frame member of the window frame, the lower portion of the surface of the drainage groove 121 of the window-frame lateral frame member goes up gradually in the outdoor direction and communicates with the top surface of the bottom frame member 130 of the window frame. In other words, the lower end portion of the drainage groove 121 of the window-frame lateral frame member has a transitional curve 125 going upward.

Likewise, the lower portion of the surface of the drainage groove 221 of the sash-frame lateral frame member goes up gradually in the outdoor direction and communicates with the top surface of the window-frame bottom frame member 230. In other words, the lower end portion of the drainage groove 221 of the window-frame lateral frame member has a transitional curve 225 going upward.

As can be seen from FIGS. 1 and 3, the drainage groove 221 has a lowermost part 225 that becomes narrower towards the frame bottom member. The lowermost part 225 also gradually rises so that it comes to coincide with the upper side of the frame bottom member.

As described above, it's possible that rain, dew and condensate may accumulate between the sash frame 200 and the sash frame covering 400. As can be appreciated from FIG. 3, there is a drainage groove 231 for the sash-frame bottom frame member configured horizontally on the top surface of the sash-frame bottom frame member 230, and exits, or drainage grooves, 232 configured along the extension of the window at the two ends of the surface of the sash-frame bottom frame member 230, so that the water can be guided to the horizontal drainage groove 231 and then to the exits, or drainage grooves, 232 at the two ends of the surface of the sash-frame bottom frame member 230, and finally discharged to the flashing member.

The window frame and the sash frame can be made of various materials, such wood, metal, metal complex material, plastics and nonmetal complex material. Another material for the sash frame is a wooden core covered with plastic material.

Particularly, the window frame 100 or sash frame 200 comprises an outer layer and an inner layer 3. The outer layer is a coating, while the inner layer is a wooden core. The coating well protects the wooden core. Therefore, the inner layer 3 can be not of quality. Thus, it decreases the production cost without lowering the quality of the entire window.

Figure 7:
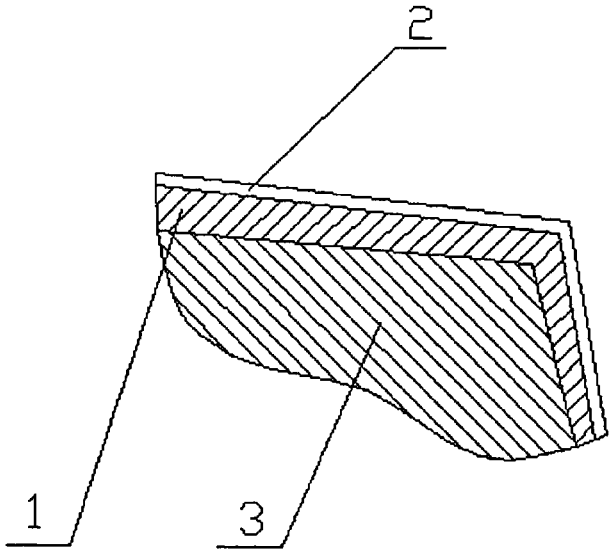
FIG. 7 is an enlarged schematic cross section of the structure of the window frame and sash frame of a roof window according to the invention.

The coating comprises two layers, one is a PUR layer 1, while the other is a painting layer 2 as can be seen in FIG. 7. The paint protects the coating.

The thickness of the PUR layer 1 of the inner layer 3 changes from thick to thin or thin to thick in certain area. In this way, it saves material to maximum, reduces the production cost and facilitates the demolding of the sash frame.

FIG. 1 shows a roof window 700 with the drainage grooves embodied according to the present invention.

The invention claimed is:

1. A roof window comprising a window frame having an inner surface, a sash frame, and a covering, each of the window frame and the sash frame including a top frame member, a horizontally-extending bottom frame member and two lateral frame members, said roof window comprising drainage grooves, characterized in that a first drainage groove is formed in the window frame, and a second drainage groove is formed in the sash frame, wherein the window frame has an inner surface adjacent to the sash frame, wherein the sash frame has an outer surface adjacent to the window frame, wherein the first drainage groove has a concave surface extending along the inner surface of the window frame and formed with a flange protruding from the inner surface of the window frame, wherein the second drainage groove has a concave surface extending along the outer surface of the sash frame, and includes a flange protruding from the outer surface of the sash frame, wherein the first drainage groove formed in the inner surface of the window frame constitutes a complex drainage channel for the window frame, while the second drainage groove formed in the outer surface of the sash frame constitutes a complex drainage channel for the sash frame, and wherein the complex drainage channel for the window frame comprises the first drainage groove formed with the lateral and bottom members of the window frame, while the complex drainage channel for the sash frame comprises the second drainage groove formed with the lateral and bottom members of the sash frame, wherein the flange of the second drainage groove in the lateral frame members of the sash is spaced horizontally from the inner surface of the window frame, and wherein the complex drainage channel for the window sash has a drainage exit.

2. A roof window according to claim 1, further comprising a top surface on the window frame flange and a bottom surface on the sash frame flange, a first sealing surface on the top surface of the window frame flange, and a second sealing surface on the bottom surface of the sash frame flange, with a sealing element sandwiched between the first and second sealing surfaces, wherein the drainage groove of the window frame is located correspondingly underneath the drainage groove of the sash frame, with the first sealing surface facing the second sealing surface, so that water overflowing from the sash frame drainage groove goes into the window frame drainage groove.

3. A roof window according to claim 1, wherein the first drainage groove has a surface in each of the lateral frame members of the window frame, wherein the first drainage groove has a surface in the top frame member of the window frame, wherein the second drainage groove has a surface in each of the lateral frame members of the sash frame, the flange of the sash frame has a top surface, a cross section of the second drainage groove surface in each of the lateral frame members of the sash frame comprises a portion of the outer surface of the sash frame and a portion of the top surface of the flange of the sash frame, wherein the cross section of the second drainage groove surface of the top frame member of the sash frame comprises a portion of the outer wall surface of the sash frame and a portion of the top surface of the flange of the sash frame, wherein the top surface of the flange of the sash frame is flat, wherein the bottom frame member of the window frame has an inner surface provided with a separate reservoir for receiving rain, dew and condensate, wherein the separate reservoir has a flat bottom surface ending with a flange formed with the inner surface of the bottom frame member of the window frame, wherein the top surface of the flange formed with the inner surface defines a sealing surface facing a corresponding sealing surface defined on the bottom frame member of the sash frame, with a sealing element sandwiched between the sealing surfaces, and wherein the separate reservoir ends with the flanges of the drainage grooves of the lateral frame members of the window frame.

4. A roof window according to claim 3, wherein the top surface of the flange of the sash frame is inwardly inclined down.

5. A roof window comprising a window frame having an inner surface, a sash frame, and a covering, each of the window frame and the sash frame including a top frame member, a bottom frame member and two lateral frame members, said roof window comprising drainage grooves, characterized in that a first drainage groove is formed in the window frame, and a second drainage groove is formed in the sash frame, wherein the window frame has an inner surface adjacent to the sash frame, wherein the sash frame has an outer surface adjacent to the window frame, wherein the first drainage groove has a concave surface extending along the inner surface of the window frame and formed with a flange protruding from the inner surface of the window frame, wherein the second drainage groove has a concave surface extending along the outer surface of the sash frame, and includes a flange protruding from the outer surface of the sash frame, wherein the first drainage groove formed in the inner surface of the window frame constitutes a complex drainage channel for the window frame, while the second drainage groove formed in the outer surface of the sash frame constitutes a complex drainage channel for the sash frame, and wherein the complex drainage channel for the window frame comprises the first drainage groove formed with the lateral and bottom members of the window frame, while the complex drainage channel for the sash frame comprises the second drainage groove formed with the lateral and bottom members of the sash frame, wherein the bottom frame member of the sash frame has a top surface, a horizontal drainage groove is positioned on the top surface of the bottom frame member of the sash frame and communicates with exits placed at both ends of the lateral frame members of the sash frame, wherein a portion of the covering is a bottom frame covering, a mounting groove is formed in the bottom frame member of the window frame, with an end of the bottom frame covering positioned in said mounting groove, whereby drainage water from the window frame can be discharged from the covering, wherein the drainage groove of the lateral frame members of the sash frame extends to the top surface of the bottom frame member of the sash frame, from which the drainage water can be discharged.

6. A roof window comprising a window frame having an inner surface, a sash frame, and a covering, each of the window frame and the sash frame including a top frame member, a bottom frame member and two lateral frame members, said roof window comprising drainage grooves, characterized in that a first drainage groove is formed in the window frame, and a second drainage groove is formed in the sash frame, wherein the window frame has an inner surface adjacent to the sash frame, wherein the sash frame has an outer surface adjacent to the window frame, wherein the first drainage groove has a concave surface extending alone the inner surface of the window frame and formed with a flange protruding from the inner surface of the window frame, wherein the second drainage groove has a concave surface extending along the outer surface of the sash frame, and includes a flange protruding from the outer surface of the sash frame, wherein the first drainage groove formed in the inner surface of the window frame constitutes a complex drainage channel for the window frame, while the second drainage groove formed in the outer surface of the sash frame constitutes a complex drainage channel for the sash frame, and wherein the complex drainage channel for the window frame comprises the first drainage groove formed with the lateral and bottom members of the window frame, while the complex drainage channel for the sash frame comprises the second drainage groove formed with the lateral and bottom members of the sash frame wherein the bottom frame member of the sash frame has a top surface, wherein the first drainage groove formed in the window frame has a lower end portion having a width which is reduced as the position for measuring the width approaches the bottom member of the window frame, wherein the second drainage groove has lower end portions on the lateral frame members of the sash frame, wherein the lower end portions have a curvature upwardly towards the top surface of the bottom frame member of the sash frame, and wherein the lower end portions of the second drainage groove have a width which is reduced as the position for measuring the width approaches the bottom member of the window frame.

* * * * *